US005085436A

United States Patent [19]

Bennett

[11] Patent Number: 5,085,436

[45] Date of Patent: Feb. 4, 1992

[54] SLOT MACHINE WITH LONG AND SHORT PSEUDO REEL STRIP

[75] Inventor: Nicholas L. Bennett, Mosman NSW, Australia

[73] Assignee: Ainsworth Nominees Pty., Ltd., Rosebery, Australia

[21] Appl. No.: 558,357

[22] Filed: Jul. 27, 1990

[51] Int. Cl.[5] ..... A63F 5/04

[52] U.S. Cl. ..... 273/143 R; 273/138 A

[58] Field of Search ..... 273/143 R, 138 A, 138 R, 273/142 J, 142 JA, 142 JB, 142 JC, 142 JD, 143 A, 143 B, 143 C, 143 D, 143 E

[56] References Cited

U.S. PATENT DOCUMENTS

| | | | |
|---|---|---|---|
| 3,918,716 | 11/1975 | Noraka et al. | 273/138 A |
| 4,448,419 | 5/1984 | Telnaes | 273/143 R |
| 4,492,379 | 1/1985 | Okada | 273/143 R |
| 4,711,451 | 12/1987 | Pajak et al. | 273/143 R |
| 4,772,023 | 9/1988 | Okada | 273/143 R |
| 4,858,932 | 8/1989 | Keane | 273/143 R |

FOREIGN PATENT DOCUMENTS

| | | | |
|---|---|---|---|
| 280649 | 4/1967 | Australia . | |
| 26764 | 4/1984 | Australia . | |
| 35272 | 11/1984 | Australia . | |
| 21918 | 4/1988 | Australia . | |
| 23593 | 4/1989 | Australia . | |
| 122138A | 10/1984 | European Pat. Off. | 273/143 R |
| 2201279 | 8/1988 | United Kingdom . | |

*Primary Examiner*—Edward M. Coven
*Assistant Examiner*—William M. Pierce
*Attorney, Agent, or Firm*—Armstrong, Nikaido, Marmelstein, Kubovcik and Murray

[57] ABSTRACT

A slot machine is provided in which the symbols or indicia to be displayed are selected by using a random number generating technique to generate a random number for each display position, the random number being selected from a range of numbers corresponding to the number of possible indicia for that position with each number corresponding uniquely to one of the indicia. A two step random number selection technique is used wherein the first step comprises selecting one of a plurality of sub-ranges of said range of numbers, one of the sub-ranges being the full range of numbers, and the second step comprises randomly selecting a number from the selected sub-range of numbers and displaying the corresponding indicia.

20 Claims, 8 Drawing Sheets

| REEL POSTION | PHYSICAL REEL STRIP |
|---|---|
| 1 | JACK |
| 2 | Q |
| 3 | K |
| 4 | 9 |
| 5 | J |
| 6 | 8 |
| 7 | 10 |
| 8 | K |
| 9 | Q |
| 10 | J |
| 11 | 10 |
| 12 | Q |
| 13 | 8 |
| 14 | 10 |
| 15 | J |
| 16 | JACKPOT 1 |
| 17 | 10 |
| 18 | J |
| 19 | JACKPOT 2 |
| 20 | 10 |

| C | B | A |
|---|---|---|
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| 10 | 10 | 10 |
| 11 | 11 | 11 |
| 12 | 12 | 12 |
| 13 | 13 | 13 |
| 14 | 14 | 14 |
| | 15 | 15 |
| | 16 | 16 |
| | 17 | 17 |
| | | 18 |
| | | 19 |
| | | 20 |

PSEUDO REEL STRIPS

| REEL POSITION | PHYSICAL REEL STRIP |
|---|---|
| 1 | JACK |
| 2 | Q |
| 3 | K |
| 4 | 8 |
| 5 | 9 |
| 6 | 10 |
| 7 | K |
| 8 | Q |
| 9 | J |
| 10 | A |
| 11 | 9 |
| 12 | 10 |
| 13 | J |
| 14 | Q |
| 15 | 9 |
| 16 | 10 |
| 17 | Q |
| 18 | J |
| 19 | 7 (JACK POT) |
| 20 | Q |

| B | A |
|---|---|
| 1 | 1 |
| 2 | 2 |
| 3 | 3 |
| 4 | 4 |
| 5 | 5 |
| 6 | 6 |
| 7 | 7 |
| 8 | 8 |
| 9 | 9 |
| 10 | 10 |
| 11 | 11 |
| 12 | 12 |
| 13 | 13 |
| 14 | 14 |
| 15 | 15 |
| 16 | 16 |
| 17 | 17 |
| | 18 |
| | 19 |
| | 20 |

PSEUDO REEL STRIPS

FIG. 3

| REEL POSTION | PHYSICAL REEL STRIP |
|---|---|
| 1 | JACK |
| 2 | Q |
| 3 | K |
| 4 | 9 |
| 5 | J |
| 6 | 8 |
| 7 | 10 |
| 8 | K |
| 9 | Q |
| 10 | J |
| 11 | 10 |
| 12 | Q |
| 13 | 8 |
| 14 | 10 |
| 15 | J |
| 16 | JACKPOT 1 |
| 17 | 10 |
| 18 | J |
| 19 | JACKPOT 2 |
| 20 | 10 |

PSEUDO REEL STRIPS

| C | B | A |
|---|---|---|
| 1 | 1 | 1 |
| 2 | 2 | 2 |
| 3 | 3 | 3 |
| 4 | 4 | 4 |
| 5 | 5 | 5 |
| 6 | 6 | 6 |
| 7 | 7 | 7 |
| 8 | 8 | 8 |
| 9 | 9 | 9 |
| 10 | 10 | 10 |
| 11 | 11 | 11 |
| 12 | 12 | 12 |
| 13 | 13 | 13 |
| 14 | 14 | 14 |
| | 15 | 15 |
| | 16 | 16 |
| | 17 | 17 |
| | | 18 |
| | | 19 |
| | | 20 |

FIG. 4

SLOT MACHINE WITH LONG AND SHORT PSEUDO REEL STRIP

The present invention relates generally to slot machines, otherwise known as fruit machines or poker machines, and in particular the invention provides an improved slot machine wherein the probability of winning combinations occurring may be altered with regard to conventional machines without changing the number of physical symbols per reel, or alternatively that the number of physical symbols per reel may be decreased, with a consequential increase in symbol size, without altering the probability of winning combinations provided on the machine occurring.

The invention relates to slot machines common to casinos and clubs where the player inserts coins into the machine and spins the reels by handle or button whereupon they become stopped at random and if the stopped symbols coincide with the pay schedule or scorecard the player is paid a prize. If it is a multi-coin machine the player may buy extra chances or multiply potential winnings.

In particular the patent application applies to slot machines with reels, the stopping position of which is random but under the control of a microprocessor; machines of this type are described in British Patent No. 1,550,732 by P.B.R. and U.S. Pat. No. 4,095,795 by Saxton.

In a bid to attract players, casinos have offered higher and higher jackpots and as these are a percentage of revenue the chances of striking a jackpot have to be proportionally less. This was attained in the past by increasing the number of reels and increasing the number of symbols on a reel.

With the development of microprocessor controlled slot machines, where the stopping position of a reel is determined by the microprocessor, a new approach was taken. Telnaes U.S. Pat. No. 4,448,419 selected stopping positions from a virtual reel strip or memory table within the microprocessor which had more virtual positions than there were physical stop positions on the reel itself. By mapping several of these virtual positions to one of the reel symbols, the probability of the reel showing one symbol became different to that for showing others of the symbols. For example, a jackpot symbol can be made to appear with less frequency than other symbols.

With the same intention Bally's U.S Pat. No. 4858932 selects the reel stopping position from a series of random numbers divided into the same number of groups as there are reel positions; however the size of each group is unequal thereby causing the appearance of a jackpot or other symbol to be of unequal probability of appearing on a pay line.

Kabushiki Kaisha Universal also describe an arrangement in their Australian Patent No. 561873 in which the slot machine periodically checks the prize value paid by the machine over the preceding period and if this value is too high, the machine adjusts the operation of the machine to make it harder for the player to win. The Kabushiki Kaisha Universal machine is of the type where the reels are stopped under player control by the player pressing a stop button and winning is made harder by introducing a delay in the reel stopping sequence after the stop button is pressed British Patent No. 2201279 (Chadwick) and U.S. Pat. Nos. 4711451 (Pajak) and 4679143 (Hagiwara) also describe methods of reducing the payout rates of slot machines, but generally by changing the payout for a given result rather than by changing the probability of the result occurring.

According to a first aspect, the present invention consists in a slot machine having display means arranged to simultaneously display a plurality of indicia selected from a set of possible indicia and random selection means arranged to select the indicia to be displayed on said display means from said set of indicia, the random selection means including random number generation means arranged to select a random number from a set of numbers having a member uniquely corresponding to each indicia display position in the display means, wherein a first table of numbers is provided containing each number in the set of numbers, at least one further table of numbers containing a sub-set of the first set of numbers, and for at least one indicia display position there is provided selection means arranged to select between the first and second look-up tables as the table to be used for a current game on the machine whereby the random number generator makes its selection from the selected table and the display means is responsive to the selected number to stop the respective reel at the corresponding indicia position.

According to a second aspect, the present invention consists in a method of operating a slot machine, having display means arranged with a plurality of display positions and being arranged to display one indicia from a set of possible indicia in each display position, and the machine being provided with a plurality of tables of numbers representing indicia displayable by the display means, each possible indicia being represented by its corresponding number in at least one of the tables and at least one of the tables being devoid of at least one member representing one of the indicia, the method of operation comprising selecting an indicia for display in at least one of the display positions by the steps of randomly selecting one of the tables of numbers, randomly selecting one number from the selected table and displaying the indicia corresponding to the selected number in the respective display position.

An embodiment of the present invention will now be described by way of example with reference to the accompanying drawings in which:

FIG. 1 illustrates a typical multi-line slot machine to which the present invention might be applied;

FIG. 2 schematically illustrates a conventional prior art reel mapping arrangement;

FIG. 3 schematically illustrates a first reel mapping arrangement in accordance with the present invention;

FIG. 4 schematically illustrates a second reel mapping arrangement in accordance with the present invention;

Figure 1:
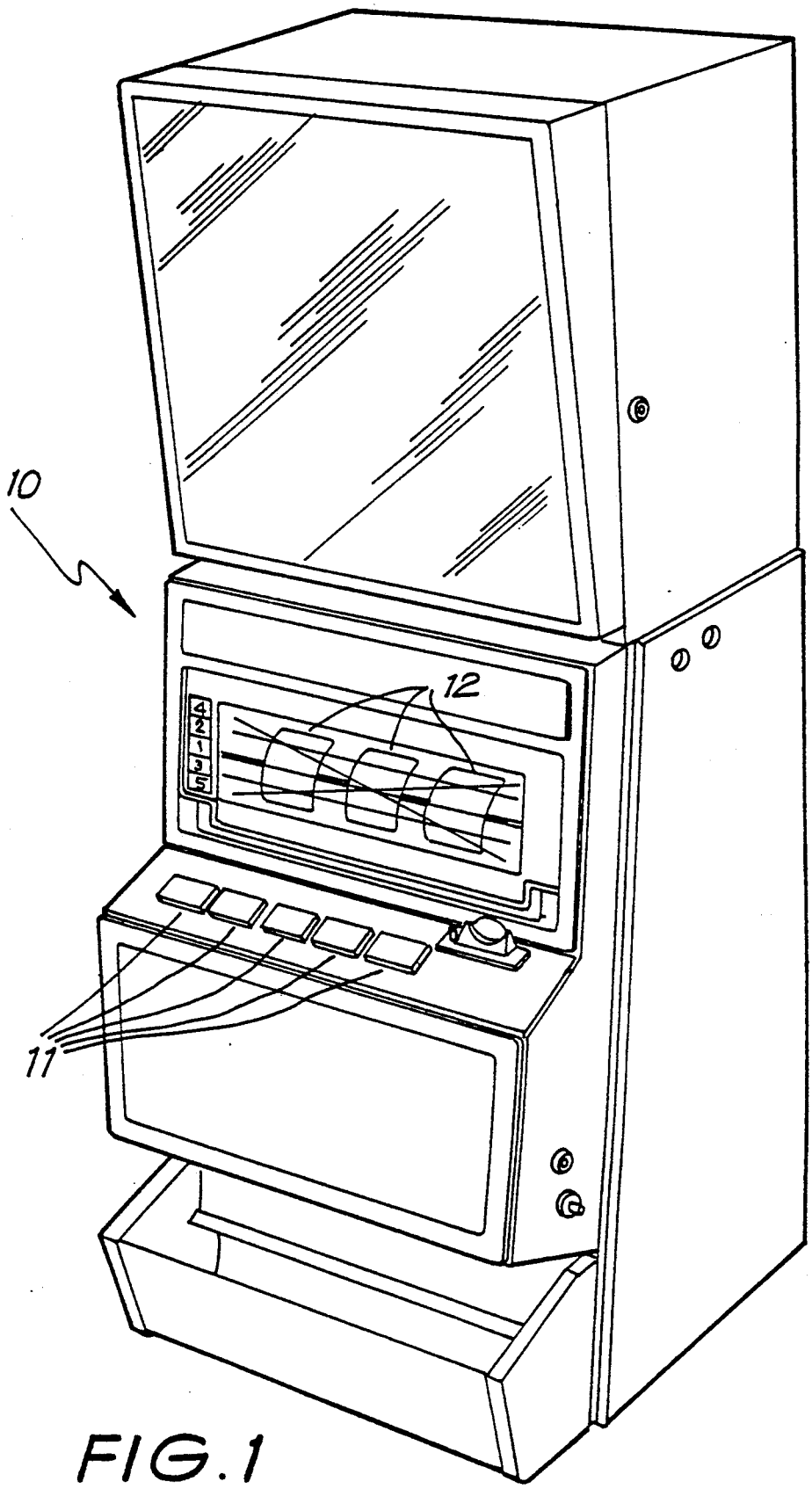
Figure 2:
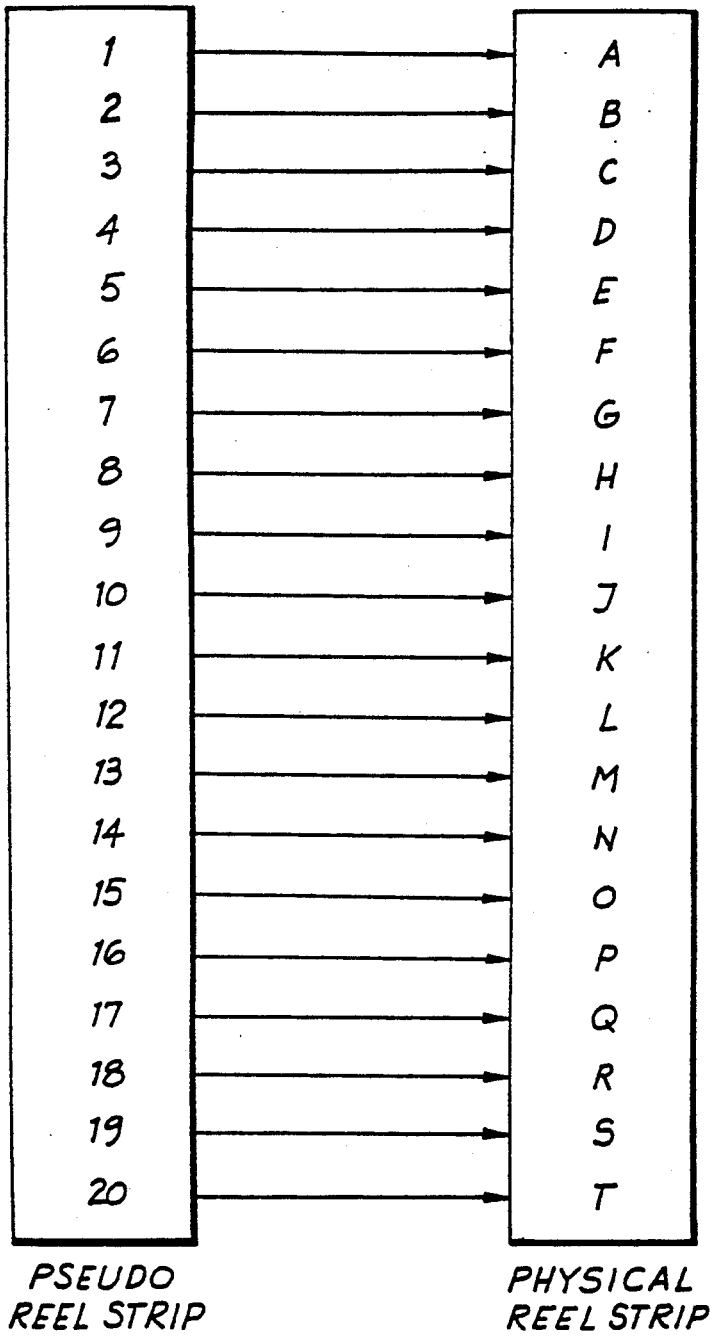

Referring to FIG. 1, in a slot machine 10 according to the present invention, a random number generator is provided, such that when a player operates one of the game starting switches 11, a set of random numbers are chosen, with one number being chosen for each reel 12 of the machine. It will be noted that in the preferred embodiment of the invention the poker machine display is provided by a plurality of stepper motor driven reels each carrying a strip of indicia such that rotation and subsequent stopping of the reel leaves one of the indicia positioned in a window, this indicia being one of the selection of indicia which are used to determine the game result. In prior art machines the random number generator makes its selection from a fixed set of random numbers which are uniquely mapped to the physical reel as illustrated in FIG. 2. However in embodiments of the present invention a plurality of ranges of random numbers are provided, and as illustrated for example in FIG. 3, one range is a sub-set of the other and each of these ranges are uniquely mapped to the physical reel. While the example illustrated in FIG. 3 provides only two ranges of numbers, it is also possible to have greater numbers of ranges to select from and the example of FIG. 4 provides three such ranges.

As a first step in selecting the stopping position for the reel a random table selection is made to determine which of the tables (Tables A and B in FIG. 3), or ranges of numbers, are to be used by the random number generator. Having chosen a table, a selection is made by the random number generator, the random numbers generated by the random number generator are then transmitted to the stepper mechanism controller which controls the spinning of the reels. The main machine controller then waits for acknowledgement that the spinning of the reels has been completed and then proceeds to make a pay, if required by the occurrence of a winning combination of reel positions.

Unlike prior art machines, slot machines according to the present invention have one memory table exactly matching the physical reel strip and at least one further memory table which is shorter than the first by three or more stopping positions corresponding with the jackpot symbol and two surrounding symbols, otherwise it is identical to the first memory table. It should be noted however that the examples given in this description are for multi-line machines in which winning combinations may appear on any one of three horizontal lines or two diagonal lines. In single line machines the first and subsequent tables may only differ in length by one number or symbol position.

The example chosen to illustrate the invention is a multi-line 20-stop, 3-reeler where we concentrate initially just on one reel. FIG. 1 shows such a machine. FIG. 3 shows the physical reel strip and the software tables A and B—A matching the physical reel strip and B being a sub-set of A.

As with prior art two table machines such as that described in the applicant's publications GB 2210489A and GB 2211338A, the embodiment using the tables of FIG. 3 chooses to operate either in Table A or Table B, preferably on a random basis to ensure that for any game the player always has a chance of a jackpot. However, the sequence of events is quite different to that of prior art two table machines. The player with credit presses the start button or handle causing Table A or Table B to be selected on a random basis (which may or may not be weighted). A random number is chosen from the range of numbers provided on the selected table and the reels are spun. The reel is then stopped at the stopping position matching the random number.

This is done directly and no mapping step is required unlike the Telnaes arrangement in which, after the random number is chosen, a table has to be consulted to determine which symbol on the reel strip is to be displayed. Care has to be taken here as the call up of a symbol central in the window can cause the appearance of an adjoining jackpot symbol. On a multiplier machine this is no problem, but on a multi-line machine can result in a jackpot on another line.

In the preferred embodiment this problem is tackled at the outset by choice of symbols on the physical reel strip. An example of how this is simply handled is shown in FIG. 3 where the seven symbol is the jackpot symbol and is located at position 19. With multi-line in mind, random numbers 18 and 20 will also result in the seven being somewhere in the window and could contribute to the jackpot prize if the player had bought that pay line.

Because of the reduced frequency with which 18 and 20 also appear, they too could be jackpot symbols; however having jackpot symbols adjoining in the window is most undesirable and accordingly common symbols are used. To make the reel strip mathematically and "visually consistent" the symbols above and below the seven match the symbols at the beginning and end of the short table.

Two jackpots can be accommodated with the present invention by using either two or using three of the tables shown in FIG. 4. For two jackpots of equal probability, Tables A and C would be used. For jackpots of unequal probability, Tables A and B could be used. Alternatively, for even higher value jackpots Tables A, B and C could be used.

As with earlier two table machines, the random selection of tables does not have to be on a 50/50 basis. Infinite variations to suit market requirements can easily be achieved by even slight variations to this ratio.

For simplicity, the jackpot symbols have been shown towards the end of the physical reel strips. However this need not be the case as the symbol, together with the one above and below it, can be placed anywhere on the reel if the remaining symbols are rearranged to suit, and the three or six random numbers being removed from the body of the table instead of at the end as we show.

Figure 5:
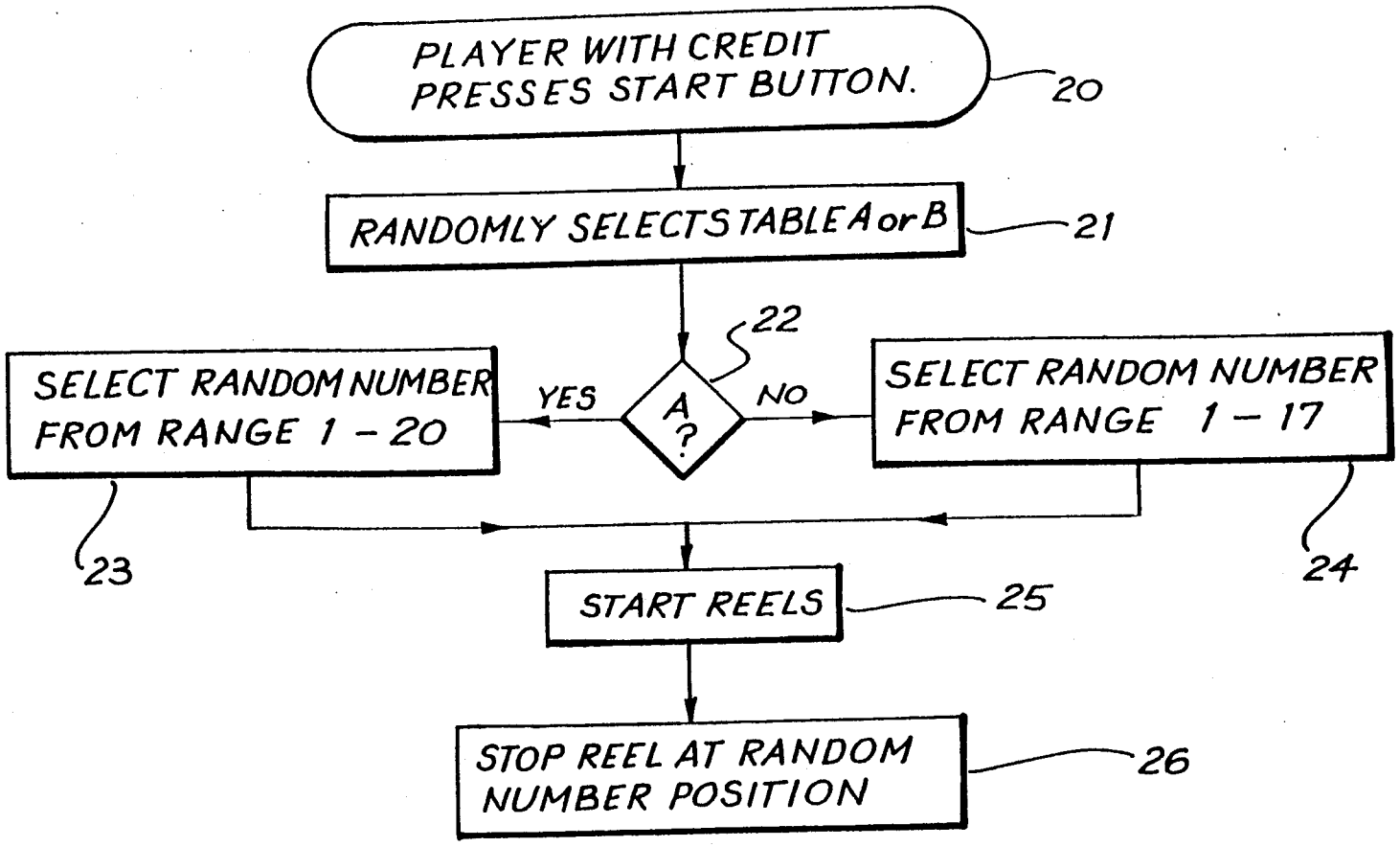
FIG. 5 illustrates a flow chart for reel control in an embodiment of the invention making use of the mapping arrangement of FIG. 3.

FIG. 5 shows sequence of operations for a one jackpot reel. In this sequence a player who has established a credit in the machine operates 20 the start button. The control program then selects 21 between Tables A and B of FIG. 3 and tests the results of the selection 22. If Table A has been selected the random number generator selects a number from the range 1–20 23 otherwise a selection from the range 1–17 is made 24. The reels are then started 25 and spin for some predetermined or random time before being stopped 26 at the position selected in step 23 or 24.

Figure 6:
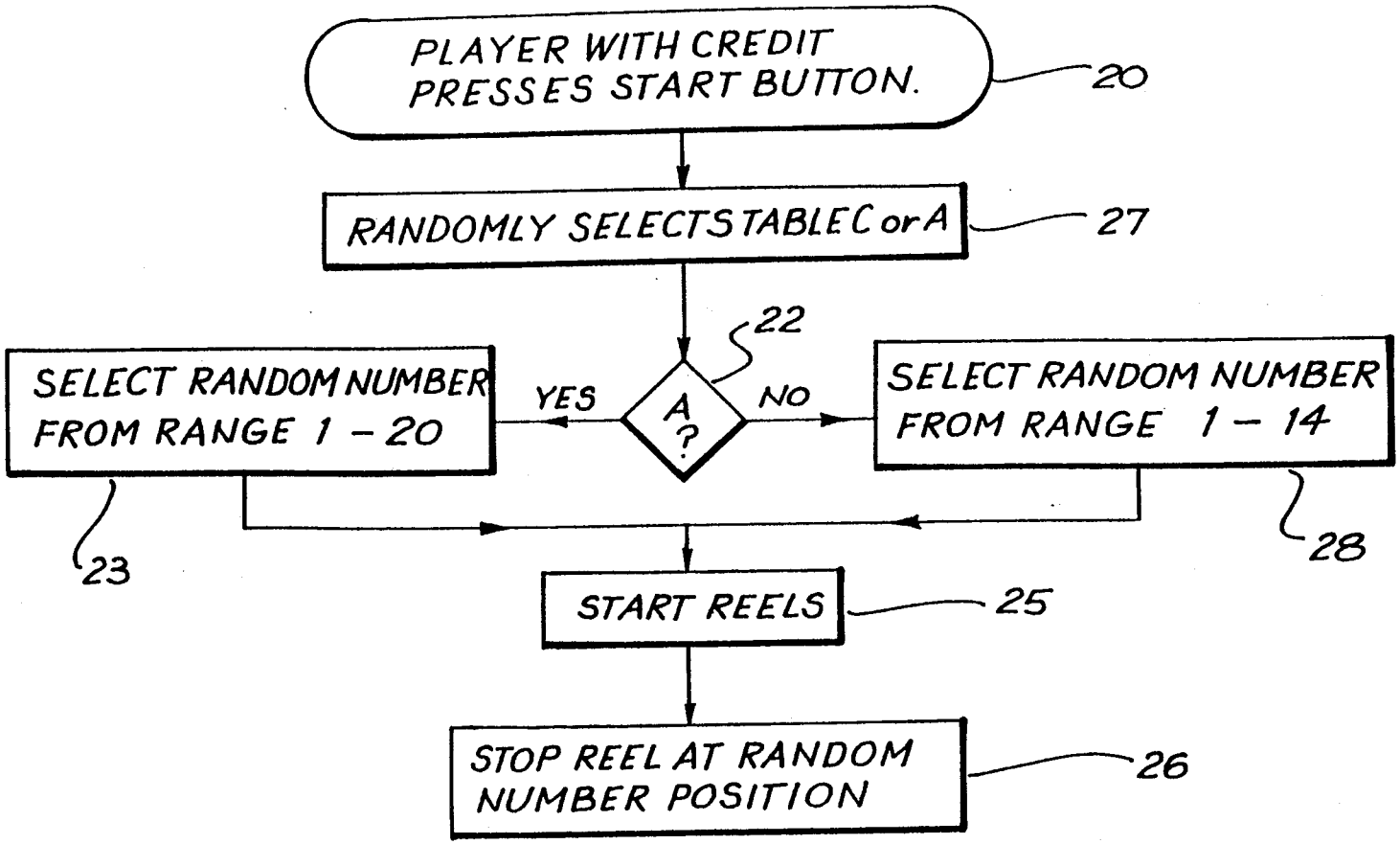
FIG. 6 illustrates a flow chart for reel control in an alternative embodiment of the invention having two jackpot symbols on each reel with equal probability of occurrence.

FIG. 6 shows sequence of operations for a two jackpot reel where each jackpot has equal probability and only two tables are needed. This sequence is essentially identical to that of FIG. 5 except that if Table A is not selected, Table C of FIG. 4 is used and step 24 is replaced by step 28 in which the random number generator selects a number from the range 1–14. As jackpot symbols are provided at positions 16 and 19 this arrangement allows two jackpots of equal probability to occur.

Figure 7:
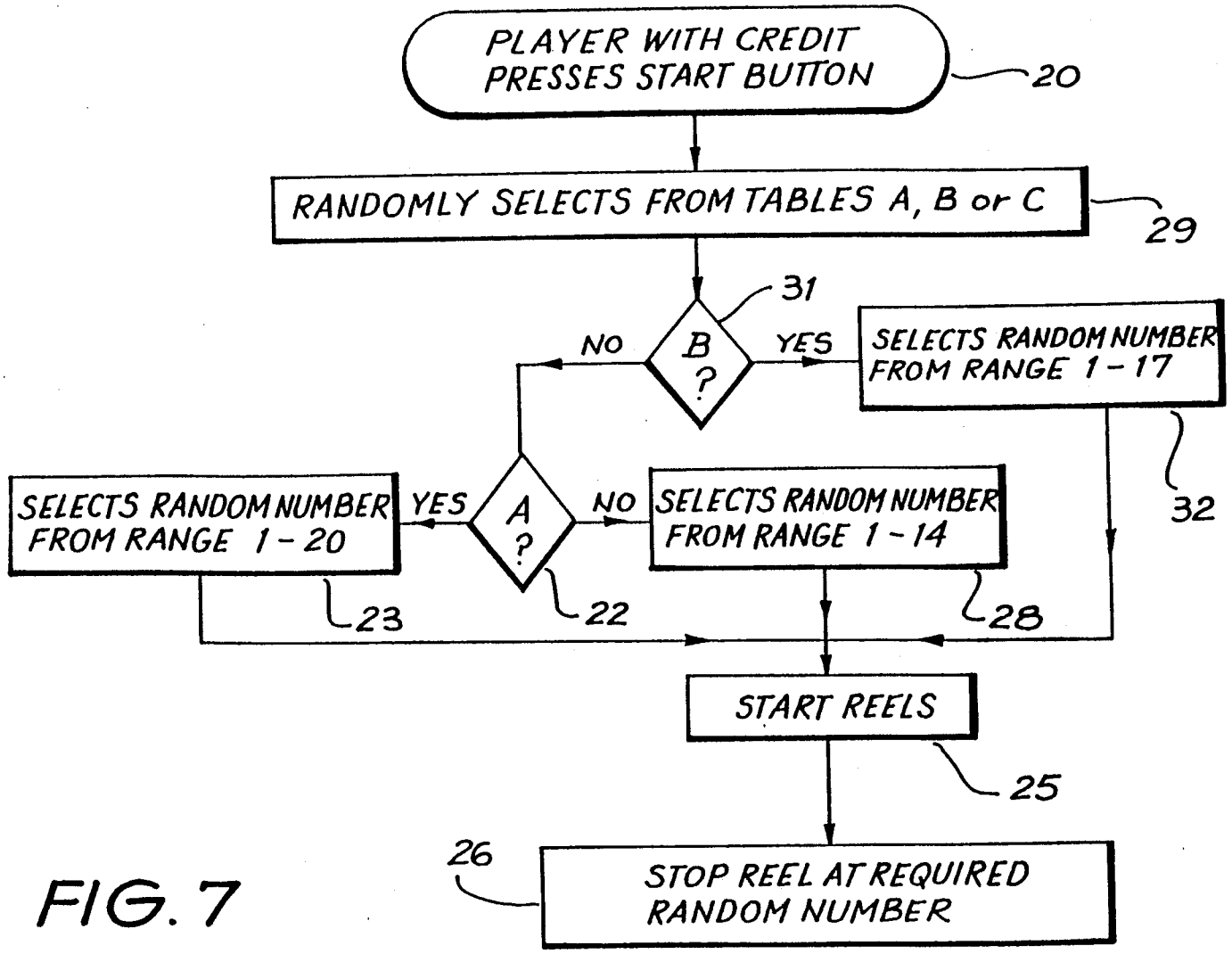
FIG. 7 illustrates a flow chart for reel control in a further alternative embodiment in which two jackpot symbols of unequal probability are provided.

FIG. 7 shows sequence of operations for a two jackpot reel where the two jackpots have unequal probability using three tables. The sequence of FIG. 7 is essentially identical to that of FIG. 6 except that step 27 is replaced by step 29 and additional steps 31 and 32 are added. In step 29 a random selection is made between Tables A, B and C and this selection is then tested to see if the result is Table B. If the selection is not Table B then the sequence continues as for FIG. 6 by testing the selection 22 to see if it is Table A and so on. However, if the selection is Table B, the random number generator is caused to make selection 32 of a number from the range 1–17 and then the reel is started 25, spun for a period of time and then stopped at the selected position 26.

Figure 8:
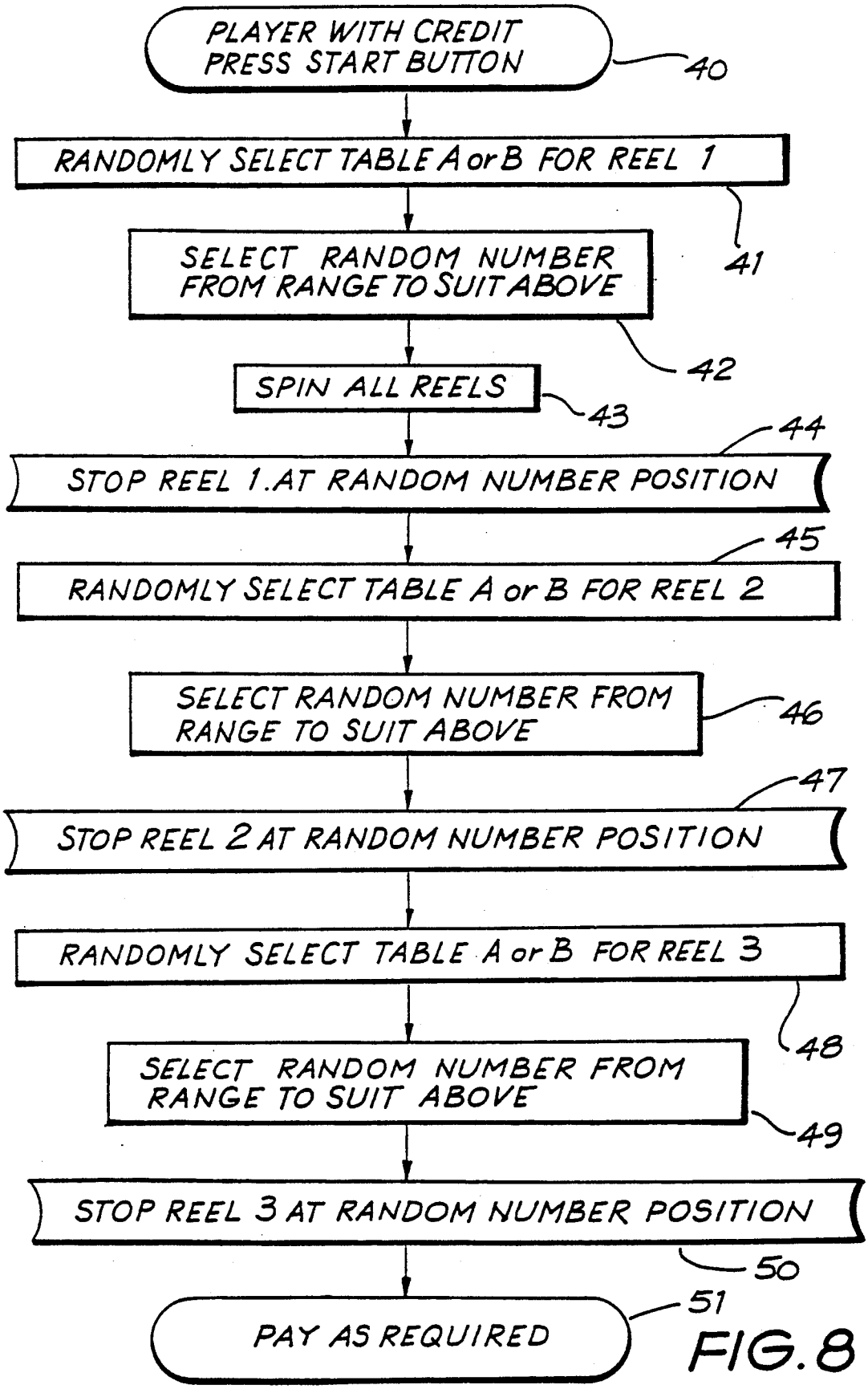
FIG. 8 illustrates a flow chart for control of the operation of a 3 reel slot machine having a single jackpot symbol per reel.

Turning now to consideration of all reels of the machine, an operating sequence for a three reel machine is illustrated in FIG. 8 (for simplicity this is shown for machines with one jackpot). In this sequence, a player with a credit established in the machine operates the start switch 40 causing the machine to select 41 between Table A and Table B for the stopping of reel 1. The random number generator then selects a number 42 from the selected table, the reels are all spun 43 and reel 1 is stopped at the selected position 44. A selection is then made 45 between Table A and Table B for the stopping of reel 2, a random number chosen 46 from the selected table and reel 2 is then stopped at the selected position 47. Finally, a selection is made 48 between Tables A and B for the stopping of reel 3, a random number is chosen from the selected table 49 and the third reel is stopped at the selected position 50. The machine will then decide if a payout is required and make any such payout 51.

While the present invention has been described for slot machines having stepping motor driven reel displays, it will be recognised that video displays or any other display having the capability to display a selected symbol or indicia may equally make use of the invention as described.

I claim:

1. A slot machine comprising:

display means including a plurality of display positions for displaying indicia, the display means having a separate indicia display means for displaying indicia for each display position, each indicia display means being arranged to display an indicium which is selected from a set of possible indicia for a corresponding display position; and random selection means for selecting the indicia to be displayed on the display positions of said display means, said random selection means including random number generation means for selecting a random number from a set of numbers having a number uniquely corresponding to each of the indicium of a set of possible indicia for at least one display position, wherein the random number generation means has a first table of numbers containing each number in the set of numbers, at least one further table of numbers containing a sub-set of the set of numbers, and for the at least one display position, selection means for selecting between the first and at least a second table as a selected table to be used for a current game on the machine whereby the random number generation means selects from the selected table and said indicia display means for the at least one display position is responsive to the selected random number so as to display a corresponding indicia at the at least one display position.

2. The slot machine of claim 1, wherein first, second and third tables are provided, the first table including a number corresponding to each indicium of the set of possible indicia for the at least one display position, the second table having one less number than the first table, the missing number corresponding to a jackpot indicia, and the third table having two less numbers than the first table, one number being the same number missing from the second table and another number corresponding to a further jackpot indicium.

3. The slot machine of claim 1, wherein first, second and third tables are provided, the first table including a number corresponding to each indicium of the set of possible indicia for the at least one display position, the second table having three less numbers than the first table, the missing numbers corresponding to a jackpot indicium and two surrounding indicia, and the third table having six less numbers than the first table, three numbers of which are the same three missing from the second table and another three numbers include one corresponding to a further jackpot indicium and two corresponding to the indicium surrounding the further jackpot indicia.

4. A slot machine according to claim 1, wherein each indicia display means includes a slot machine reel with a plurality of indicia.

5. A slot machine according to claim 1, wherein said random number generating means for selecting a random number further selects a random number from a set of numbers with a specific number uniquely corresponding to each indicium of the set of possible indicia for each display position, and said selection means for selecting the indicia to be displayed further selects between the first and at least one further table as a selected table for the display position, the selected table to be used for selecting a number for the display position, whereby the random number generation means selects from the selected table and the indicia display means for the display position is responsive to a selected random number so as to display an indicium that corresponds to a specific number.

6. The slot machine of claim 1, wherein said first and second tables of numbers are provided.

7. The slot machine of claim 6, wherein the first table includes a number corresponding to each indicium of the set of possible indicia for the at least one display position and the second table has one less number than the first table, the missing number corresponding to a jackpot indicia.

8. The slot machine of claim 6, wherein the first table includes a number corresponding to each indicium of the set of possible indicia for the at least one display position and the second table has two less numbers than the first table, the missing numbers corresponding to each of two jackpot indicia.

9. The slot machine of claim 6, wherein the first table includes a number corresponding to each indicium of the set of possible indicia for the at least one display position and the second table has six less numbers than the first table, the missing numbers corresponding to each of two jackpot indicia and respective surrounding indicia.

10. The slot machine of claim 6, wherein the first table includes a number corresponding to each indicium of the set of possible indicia for the at least one display position and the second table has three less numbers than the first table, the missing numbers corresponding to a jackpot indicium and two surrounding indicia.

11. The slot machine of claim 10, further comprising:

weighting means for weighting random selection of the first or second table to produce a specific overall average player return.

12. The slot machine of claim 10, further comprising:

weighting means for variably weighting random selection so as to enable variations in overall return of the machine without having to alter the machine.

13. A method of operating a slot machine having display means arranged with a plurality of display positions, the display means including a separate indicia display means for displaying indicia for each display position, each of the indicia display means being arranged to display an indicium which is selected from a set of possible indicia for that display position and, at least one display position being provided with a plurality of tables of numbers representing indicia displayable by the indicia display means, each possible indicia being represented by its corresponding number in at least one of the tables and at least one of the tables being devoid of at least one number representing one of the indicia, the method of operation for the at least one display position comprising the steps of:

randomly selecting one of the tables of numbers;

randomly selecting one number from the selected table;

selecting an indicium corresponding to the selected number for display; and displaying the indicium in the respective display position.

14. A method of operating a slot machine according to claim 11, wherein the plurality of tables of numbers includes indicia displayable by indicia display means for each display position, and the method of operation further comprising the steps of selecting a first display position for operation of the random selecting and displaying steps; and selecting a next display position for operation of the random selecting and displaying steps until all of a plurality of display positions are selected for operation.

15. The method of claim 13, wherein randomly selecting one of the tables includes randomly selecting a first one of the tables having a table containing numbers representing each displayable indicium for the at least one display position.

16. The method of claim 15, wherein randomly selecting one of the tables includes randomly selecting a second one of the tables having one less number than the first table, the missing number representing a jackpot indicium.

17. The method of claim 16, wherein randomly selecting one of the tables includes randomly selecting a third one of the tables having a further number less than the second table, the further missing number representing a further jackpot indicium.

18. The method of claim 16 wherein randomly selecting one of the tables includes randomly selecting a second one of the tables that is missing at least two numbers contained in the first table, each of the missing numbers representing different jackpot indicia.

19. The method of claim 15, wherein randomly selecting one of the tables includes randomly selecting a second one of the tables having three less numbers than the first table, one of the missing numbers representing a jackpot indicium.

20. The method of claim 19, wherein randomly selecting one of the tables includes randomly selecting a third one of the tables having a further three less numbers than the second table, one of the further missing numbers representing a further jackpot indicium.

* * * * *